US008055172B2

(12) United States Patent
Taniguchi et al.

(10) Patent No.: US 8,055,172 B2
(45) Date of Patent: Nov. 8, 2011

(54) FUSING DEVICE WITH A WEB END DETECTOR AND IMAGE FORMING APPARATUS INCORPORATING SAME

(75) Inventors: Tadasu Taniguchi, Uda (JP); Masahiko Fujita, Nara (JP); Masaya Asakawa, Yamatokoriyama (JP); Yasuaki Fukada, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 271 days.

(21) Appl. No.: 12/277,517

(22) Filed: Nov. 25, 2008

(65) Prior Publication Data

US 2009/0148203 A1 Jun. 11, 2009

(30) Foreign Application Priority Data

Dec. 11, 2007 (JP) ..... 2007-319570

(51) Int. Cl.
*G03G 15/20* (2006.01)

(52) U.S. Cl. ..... 399/327; 399/352

(58) Field of Classification Search ..... 399/327, 399/352

See application file for complete search history.

(56) References Cited

U.S. PATENT DOCUMENTS

| | | | | |
|---|---|---|---|---|
| 7,715,773 | B2 | 5/2010 | Ide et al. | |
| 2007/0258739 | A1 * | 11/2007 | Ide et al. | 399/327 |

FOREIGN PATENT DOCUMENTS

| | | | |
|---|---|---|---|
| CN | 101034274 | A | 9/2007 |
| JP | 7-334026 | A | 12/1995 |
| JP | 8-87194 | A | 4/1996 |
| JP | 11-352817 | A | 12/1999 |
| JP | 2005-321624 | A | 11/2005 |
| JP | 2006-098692 | A | 4/2006 |
| JP | 2006-243001 | | 9/2006 |
| JP | 2007-240569 | A | 9/2007 |

* cited by examiner

*Primary Examiner* — David Gray
*Assistant Examiner* — G. M. Hyder
(74) *Attorney, Agent, or Firm* — Nixon & Vanderhye P.C.

(57) ABSTRACT

To provide a fusing unit including a fusing roller for fixing an unfixed toner image to a sheet and a fusing roller cleaning unit including a web sheet delivering roller for supplying a web sheet and a winding roller for taking up the web sheet for cleaning the fusing roller, the fusing roller cleaning unit includes a web detecting terminal for detecting the presence of the web sheet and a tension roller for guiding the web sheet, on the upstream side of a pressure roller with respect to the web sheet's direction of conveyance and first and second guide rollers, the second guide roller being disposed upstream of the web detecting terminal.

9 Claims, 4 Drawing Sheets

FUSING DEVICE WITH A WEB END DETECTOR AND IMAGE FORMING APPARATUS INCORPORATING SAME

This Nonprovisional application claims priority under 35 U.S.C. §119 (a) on Patent Application No. 2007-319570 filed in Japan on 11 Dec. 2007, the entire contents of which are hereby incorporated by reference.

BACKGROUND OF THE TECHNOLOGY (1) Field of the Invention

The present technology relates to a fusing device and an image forming apparatus using this, in particular relating to a fusing device including a cleaning device of a web-cleaning type for cleaning the surface of a rotating roller member by pressing a web material against the outer peripheral surface of the roller member as well as to an image forming apparatus for performing printout of images by fixing toner images onto recording media using the above fusing device.

(2) Description of the Prior Art

Conventionally, in an image forming apparatus such as a facsimile machine, printer, etc., using electrophotography, image forming is performed by electrifying a rotationally driven photoreceptor drum with a charger, forming an electrostatic latent image on the photoreceptor drum by light irradiation of image information, forming a toner image by adhering toner to the electrostatic latent image and transferring the toner image onto a recording medium such as a sheet medium, paper or the like.

In this image forming apparatus, a fusing device for fusing and fixing unfixed toner onto the recording medium being conveyed is provided. Most of such fusing devices include a pair of roller elements, namely a heat roller and a pressing roller, disposed at the position where the unfixed toner is fused and fixed, or in essence, use a thermal fusing roller process, in which the toner on the recording medium is imparted with heat through the press-contact area (fusing nip portion) between these two rollers so as to fix the toner to the recording medium.

In the fusing device thus configured, the unfixed toner is fused and fixed through the fusing nip between the heat roller and pressing roller. However, all the toner cannot be fixed to the recording medium during this fusing process, hence part of the toner in its fused condition adheres to the heat roller surface and remains thereon, so that it will turn with the heat roller. If a next printing operation is performed under this condition, there occurs the problem that the paper is dirtied on the backside and/or on the printed side.

To deal with this, as a mechanism for reducing the toner that has adhered to and remains on the heat roller surface, a cleaning device of a so-called web-cleaning type that cleans the roller surface by applying a web material over the heat roller has been known.

For example, as a conventional technology there has been a cleaning device which, in order to perform stable cleaning, includes a crown-shaped or counter-crown-shaped heat roller and a pressure roller for applying the web material against the heat roller in the form of a counter-crown shape or crown shape corresponding to the aforementioned shape of the heat roller, to thereby prevent the web material from skewing (see patent document 1: Japanese Patent Application Laid-open Hei08 No. 87194).

However, the known cleaning device using the conventional web-cleaning technique is adapted to perform end detection of the web sheet by using metal conduction, and there has been the problem that this sensor for end detection exerts influence on the web sheet.

For example, as a conventional technology shown in FIGS. 1A, 1B and 1C, there is a known configuration in which when end detection of a web sheet 121 is carried out in a conventional cleaning device 120A, a web detecting terminal (end detecting terminal) 126 arranged adjacent to a metal guide roller 124 for guiding conveyance of web sheet 121 in a unit case 120*a* is used. A reference numeral 122 in the drawing designates a pressure roller, 127 a web sheet delivery roller for supplying web sheet 121, and 128 a winding roller for winding up web sheet 121. An arrow A in the drawing represents the direction in which web sheet 121 is conveyed.

In this configuration, strain arises in web sheet 121 (area E) on the downstream side, with respect to the web sheet's direction of conveyance, of pressure roller 122 as shown in FIG. 1B, on the side where web detecting terminal 126 is arranged while a slack arises in area F of web sheet 121 where no web detecting terminal 126 exists, as shown in FIG. 1C.

Because strain and slack occur at the same time across web sheet 121 due to influence of this web detecting terminal 126, there occurs the problem that rumples 121*a* and skewing arise in web sheet 121 as shown in FIG. 1A, giving rise to the cause of cleaning failure.

SUMMARY OF THE TECHNOLOGY

This technology has been devised in view of the above conventional problems, it is therefore an object of the present technology to provide a fusing device and an image forming apparatus using a device that can prevent the web material from being rumpled and skewing so as to positively clean the toner having adhered on the fusing roller surface.

In order to achieve the above object, the configurations of the fusing device and the image forming apparatus using this are as follows:

A fusing device according to the first aspect of the present technology, includes: fusing rollers, including a pair of roller members, which pass a recording medium with an unfixed toner image formed thereon through the nip portion where the two roller members come into press-contact with each other so as to fuse and fix the toner image onto the recording medium; and a cleaning mechanism, including a web material feeder for supplying a web material and a web material winding portion for taking up the web material, and arranged so as to abut the web material against the outer peripheral surface of the fusing roller to clean the roller surface, and is characterized in that the cleaning mechanism further includes: a web material detector which abuts the web material to detect the presence of the web material; and a guide member for guiding conveyance of the web material, on the upstream side of the position where the web material abuts the fusing roller, with respect to the web material's direction of conveyance, and the guide member is arranged in the vicinity of the web material detector.

A fusing device according to the second aspect is preferably the fusing device having the above first aspect, further comprising a metal roller for guiding conveyance of the web material, wherein the metal roller is arranged at a position where the web material detector abuts the web martial, so as to oppose the web material detector with the web material put in between, and the web material detector abuts the metal roller when the web material does not exist on the metal roller.

A fusing device according to the third aspect is preferably the fusing device having the above first or second aspect, further characterized in that the guide member is arranged upstream of the web material detector with respect to the web material's direction of conveyance.

A fusing device according to the fourth aspect is preferably the fusing device having any one of the above first through third aspects, further characterized in that the guide member is provided along the width direction of the web material across the range wider than the width of the web material.

A fusing device according to the fifth aspect is preferably the fusing device having any one of the above first through fourth aspects, further characterized in that the guide member applies uniform tension to the web material in the web material's direction of conveyance across the full width of the web material.

A fusing device according to the sixth aspect is preferably the fusing device having any one of the above first through fifth aspects, further characterized in that the guide member is a metal roller.

An image forming apparatus according to the present technology includes: a photoreceptor drum for forming an electrostatic latent image and forming a toner image based on the electrostatic latent image; a developing unit including a developing roller for supplying toner to the photoreceptor drum; a transfer portion for transferring the toner image formed on the photoreceptor drum to a recording medium being conveyed; and, a fusing device for fusing the toner image and fixing it to the recording medium, by passing the recording medium with the unfixed toner image formed thereon through itself, and is characterized in that the printout is performed electrophotographically by transferring the toner image formed on the photoreceptor drum surface to the recording medium, and the fusing device according to any one of the above first to sixth aspects is employed as the fusing device.

According to the fusing device of the first aspect, slack of the web material which would arise in the area where the web does not abut the web material detector due to abutment of the web material detector against the web material can be suppressed, it is hence possible to achieve reliable cleaning of the toner that has adhered to the fusing roller without causing the web material to be rumpled or skewed.

According to the fusing device of the second aspect, it is possible to easily realize web end detection by use of metal conduction.

According to the fusing device of the third aspect, it is possible to efficiently eliminate slack of the web material on the upstream side of the web material detector that would arise due to abutment of the web material detector.

According to the fusing device of the fourth aspect, it is possible to suppress occurrence of slack across the full width of the web material.

According to the fusing device of the fifth aspect, it is possible convey the web material without producing any slack.

According to the fusing device of the sixth aspect, since the roller itself will not be flexed by the tension of the web material hence the web material can be conveyed without skewing.

With an image forming apparatus of the present technology, since any slack arising across the web material can be suppressed, it is possible to reliably clean the toner having adhered to the fusing roller surface by preventing the web material from rumpling and skewing. As a result it is possible to realize an image forming apparatus which can reliably prevent the recording mediums from being dirtied with toner that remains on the fusing roller.

DESCRIPTION OF THE PREFERRED EMBODIMENTS

The embodiment of the present technology will hereinafter be described in detail with reference to the accompanying drawings.

Figure 1A:
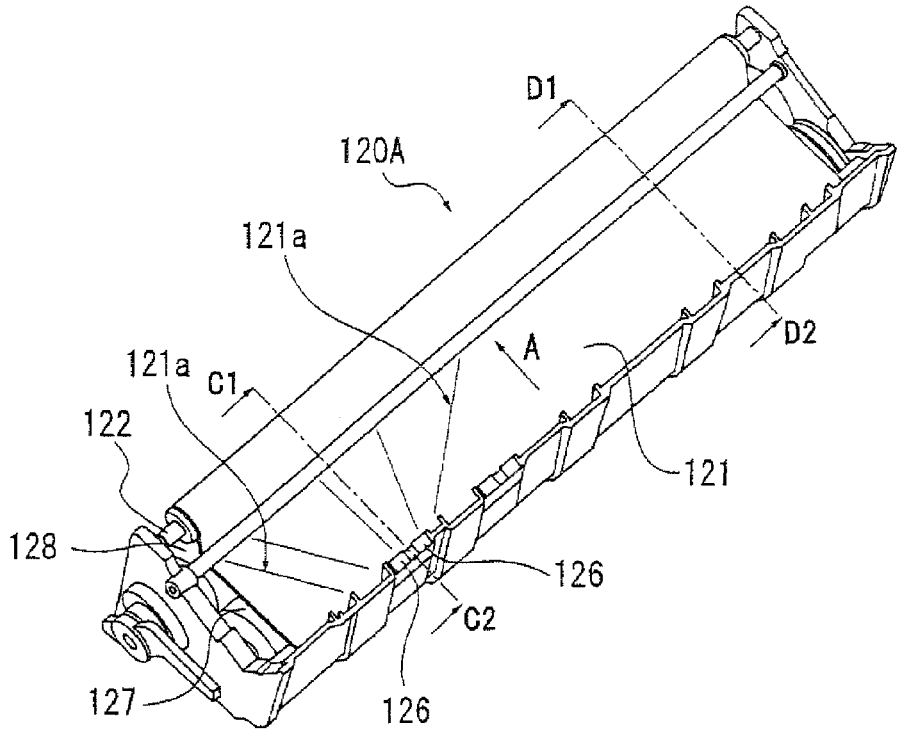
FIG. 1A PRIOR ART
FIG. 1A is an illustrative view showing the overall configuration of a conventional fusing roller cleaning unit.
Figure 1B:
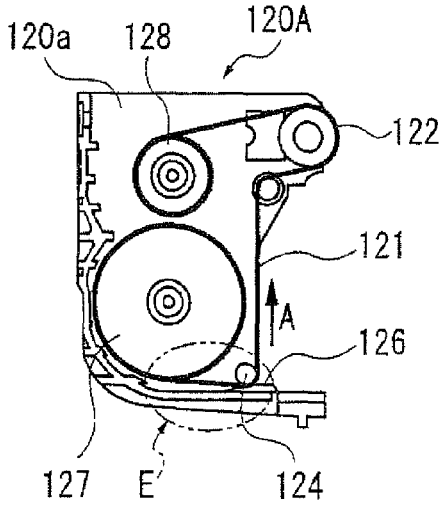
FIG. 1B PRIOR ART
FIG. 1B is a sectional view cut along a plane C1-C2 in FIG. 1A
Figure 1C:
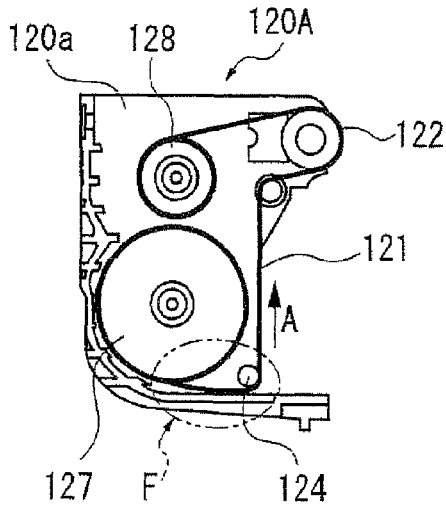
FIG. 1C PRIOR ART
FIG. 1C is a sectional view cut along a plane D1-D2 in FIG. 1A.
Figure 2:
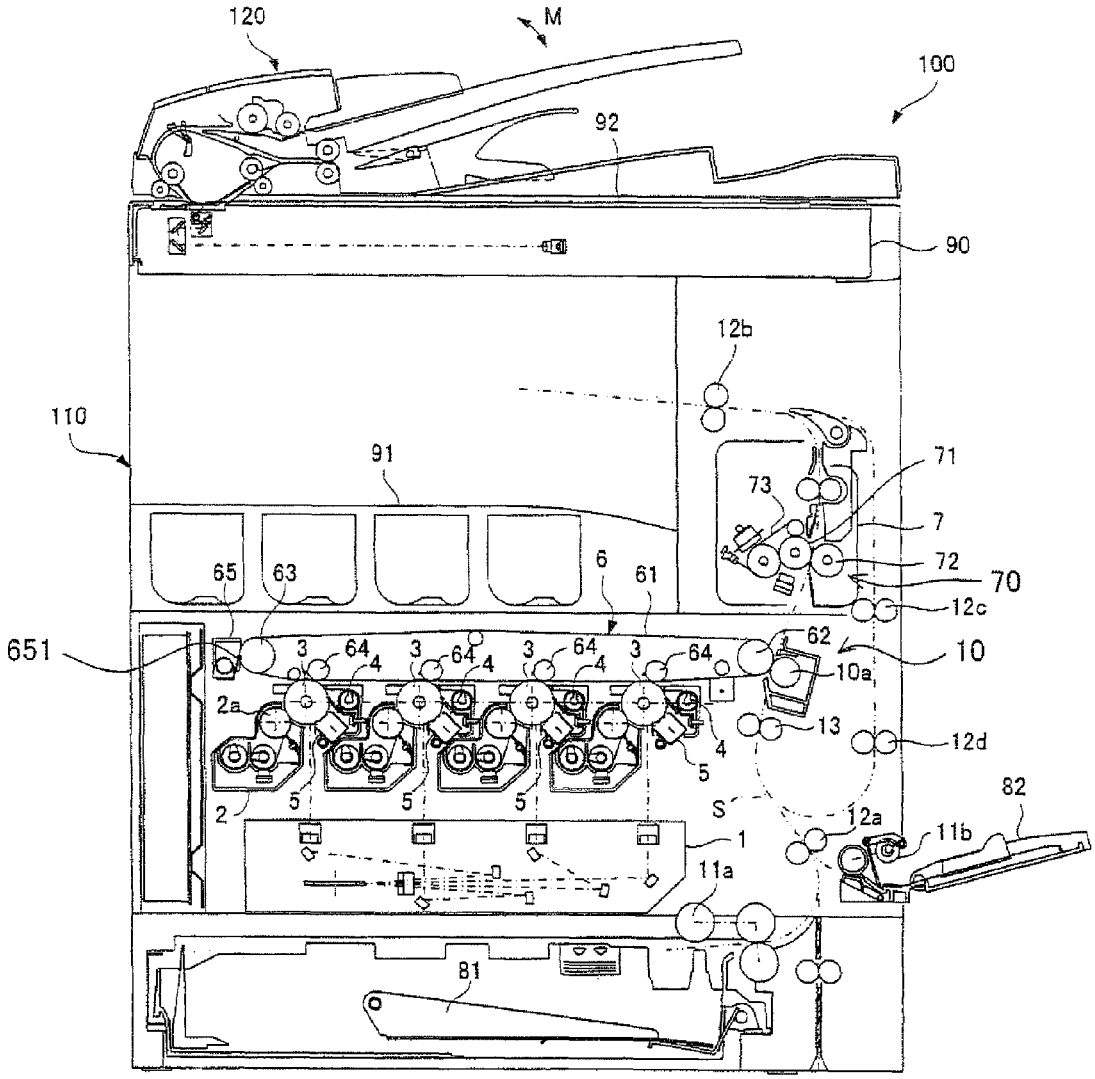
FIG. 2 is an illustrative view showing the overall configuration of an image forming apparatus.
Figure 3:
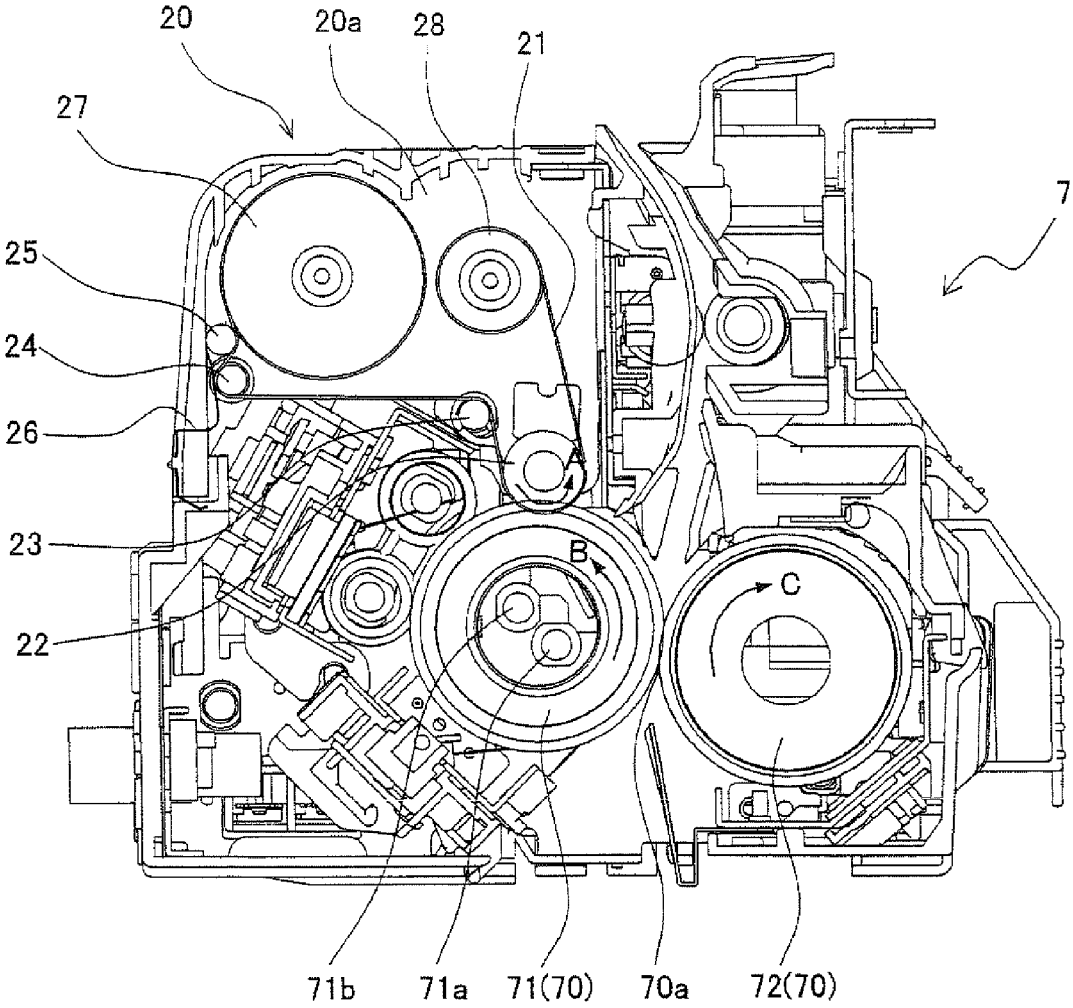
FIG. 3 is a schematic view showing the configuration of the fusing unit; and, FIG. 4A is an illustrative view showing the overall configuration of a fusing roller cleaning unit that constitutes the fusing unit.

FIG. 2 is an illustrative view showing the overall configuration of an image forming apparatus adopting a fusing unit (fusing device) that includes the present technology, and FIG. 3 is a schematic view showing the configuration of the fusing unit.

An image forming apparatus 100 according to the present embodiment includes: as shown in FIGS. 2 and 3, photoreceptor drums 3 on which electrostatic latent images are formed and toner images are formed based on the electrostatic latent images; developing units (developing portions) 2 including developing rollers 2*a* for supplying toner to photoreceptor drums 3; a transfer portion 10 for transferring the toner images formed on photoreceptor drums 3 to the sheet (recording medium) being conveyed; and a fusing unit (fusing device) 7, and performs printing of the toner images formed on the surfaces of photoreceptor drums 3 by electrophotography.

Fusing unit 7 includes fusing rollers 70 and a fusing roller cleaning unit (cleaning mechanism) 20.

Fusing rollers 70 are composed of a pair of rollers, a heat roller 71 and pressing roller 72, and fix the toner image to a sheet by passing the sheet with an unfixed toner image formed thereon through the nip portion where these two rollers are put in press-contact with each other.

Fusing roller cleaning unit 20 includes a web sheet delivering roller (web material feeder) 27 for supplying a web sheet (web material) 21 and a winding roller (web material winder) 28 for winding up web sheet 21, and cleans the roller surface by pressing web sheet 21 against the outer peripheral surface of fusing roller 70.

To being with, the overall configuration of image forming apparatus 100 according to the present embodiment will be described.

Image forming apparatus 100 forms a multi-colored or monochrome image on a predetermined sheet (e.g., recording paper) in accordance with image data transmitted from an external device, and is mainly composed of a main apparatus body 110 and an automatic document processor 120.

Main apparatus body 110 includes: an exposure unit 1; developing units 2, photoreceptor drums 3, cleaning units 4, chargers 5, an intermediate transfer belt unit 6, fusing unit 7, a paper feed cassette 81 and a paper output tray 91.

Arranged on top of main apparatus body 110 is a document table 92 made of a transparent glass plate on which a document is placed. On the top of document table 92, automatic document processor 120 is mounted.

Automatic document processor 120 automatically feeds documents onto document table 92.

This document processor 120 is constructed so as to be pivotal in the directions of bidirectional arrow M so that a document can be manually placed by opening the top of document table 92.

The image data handled in image forming apparatus 100 is data for color images of four colors, i.e., black (K), cyan (C), magenta (M) and yellow (Y).

Accordingly, four developing units 2, four photoreceptor drums 3, four chargers 5, four cleaning units 4 are provided to produce four electrostatic latent images corresponding to black, cyan, magenta and yellow. That is, four imaging stations are constructed thereby.

Exposure unit 1 corresponds to the image writing device, and is constructed as a laser scanning unit (LSU) having a laser emitter, reflection mirrors, etc. In this exposure unit 1, a polygon mirror for scanning a laser beam, optical elements such as lenses and mirrors for leading the laser beam reflected off the polygon mirror to photoreceptor drums 3 are laid out.

As exposure unit 1, other methods using an array of light emitting elements such as an EL or LED writing head, for example may be used instead.

This thus constructed exposure unit 1 has the function of illuminating each of the electrified photoreceptor drums 3 with light in accordance with the input image data to form an electrostatic latent image corresponding to the image data on the surface of each photoreceptor drum 3.

Developing unit 2 visualizes the electrostatic latent images formed on photoreceptor drums 3 with four color (YMCK) toners.

Photoreceptor drums 3 each have a cylindrical form and are disposed over exposure unit 1. The surface of each photoreceptor drum 3 is cleaned by cleaner unit 4 and then uniformly electrified by charger 5.

Cleaner unit 4 removes and collects the toner left over on the photoreceptor drum 3 surface after development and image transfer.

Charger 5 is the charging means for uniformly electrifying the photoreceptor drum 3 surface at a predetermined potential. Other than the corona-discharge type chargers shown in FIG. 2, chargers of a contact roller type or brush type may also be used.

Intermediate transfer belt unit 6 arranged over photoreceptor drums 3 is comprised of an intermediate transfer belt 61, an intermediate transfer belt drive roller 62, an intermediate transfer belt driven roller 63, intermediate transfer rollers 64 and an intermediate transfer belt cleaning unit 65.

Four intermediate transfer rollers 64 are arranged corresponding to four YMCK colors.

Intermediate transfer belt drive roller 62, intermediate transfer belt driven roller 63 and intermediate transfer rollers 64 support and tension intermediate transfer belt 61 to circulatively drive the belt.

Intermediate transfer belt 61 is an endless film of about 100 μm to 150 μm thick and is arranged so as to contact with each photoreceptor drum 3. The toner images of different colors formed on photoreceptor drums 3 are sequentially transferred in layers to intermediate transfer belt 61, forming a color toner image (multi-color toner image) on intermediate transfer belt 61.

Transfer of toner images from photoreceptor drums 3 to intermediate transfer belt 61 are performed by intermediate transfer rollers 64 that are in contact with the rear side of intermediate transfer belt 61.

Each intermediate transfer roller 64 is adapted to apply a transfer bias to intermediate transfer belt 61 to transfer the toner image on photoreceptor drum 3 onto intermediate transfer belt 61. Detailedly, a high-voltage transfer bias (high voltage of a polarity (+) opposite to the polarity (−) of the static charge on the toner) is applied to intermediate transfer roller 64 in order to transfer the toner image.

Intermediate transfer roller 64 is a roller that is formed of a base shaft made of metal (e.g., stainless steel) having a diameter of 8 to 10 mm and a conductive elastic material (e.g., EPDM, foamed urethane or the like) coated on the shaft surface. This conductive elastic material enables uniform application of a high voltage to intermediate transfer belt 61. Though the transfer electrodes in the form of rollers are used in the present embodiment, brushes and the like can also be used instead of intermediate transfer rollers 64.

The visualized toner images of colors on different photoreceptor drums 3 are laid over one after another on intermediate transfer belt 61. The thus laminated toner image as the image information is conveyed as intermediate transfer belt 61 moves, and is transferred to the sheet being conveyed separately by a transfer roller 10*a* that is arranged at the contact position between intermediate transfer belt 61 and the sheet.

In this process, intermediate transfer belt 61 and transfer roller 10*a* are pressed against each other forming a predetermined nip while a voltage for transferring the toner to the paper (a high voltage of a polarity (+) opposite to the polarity (−) of the static charge on the toner) is applied to transfer roller 10*a*.

In order to constantly obtain the predetermined nip, either transfer roller 10*a* or intermediate transfer belt drive roller 62 is formed of a hard material (metal or the like) while the other is formed of a soft material such as an elastic roller or the like (elastic rubber roller, foamed resin roller etc.).

Since the toner adhering to intermediate transfer belt 61 as the belt comes in contact with photoreceptor drums 3, or the toner which has not been transferred by transfer roller 10*a* to the sheet and remains on intermediate transfer belt 61, would cause color contamination of toners in the toner image formed at the next operation, the remaining toner is adapted to be removed and collected by intermediate transfer belt cleaning unit 65.

Intermediate transfer belt cleaning unit 65 is arranged at a position, along the path in which intermediate transfer belt 61 is conveyed, downstream of transfer roller 10*a* and upstream of photoreceptor drums 3 with respect to the intermediate transfer belt's direction of movement.

Intermediate transfer belt cleaning unit 65 includes a cleaning blade 651 as a cleaning member that comes in contact with intermediate transfer belt 61 and clean the surface of intermediate transfer belt 61. Intermediate transfer belt 61 is supported from its interior side by intermediate transfer belt driven roller 63, at the portion where this cleaning blade 651 comes into contact with the belt.

Paper feed cassette 81 is a tray for stacking sheets to be used for image forming and is arranged under exposure unit 1 of main apparatus body 110. Also, a manual paper feed cassette 82 that permits sheets to be supplied from without is arranged outside main apparatus body 11.

This manual paper feed cassette 82 can also hold a plurality of sheets to be used for image forming. Arranged in the upper part of main apparatus body 110 is a paper output tray 91 which collects printed sheets facedown.

Main apparatus body 110 further includes a paper feed path S that extends approximately vertically to convey the sheet from paper feed cassette 81 or manual paper feed cassette 82 to paper output tray 91 by way of transfer roller 10*a* and fusing unit 7. Arranged along paper feed path S from paper feed cassette 81 or manual paper feed cassette 82 to paper output tray 91 are pickup rollers 11*a* and 11*b*, a plurality of feed rollers 12*a* to 12*d*, a registration roller 13, transfer roller 10*a*, fusing unit 7 and the like.

Feed rollers 12*a* to 12*d* are small rollers for promoting and supporting conveyance of sheets and are arranged along paper feed path S.

Pickup roller 11*a* is arranged near the end of paper feed cassette 81 so as to pick up sheets, one by one, from paper feed cassette 81 and deliver it to paper feed path S.

Pickup roller 11*b* is arranged near the end of manual paper feed cassette 82 so as to pick up the sheets, one by one, from manual paper feed cassette 82 and deliver it to paper feed path S.

Registration roller 13 temporarily retains the sheet that is conveyed along paper feed path S. This roller has the function of delivering the sheet toward transfer roller 10*a* at such a timing that the front end of the paper will meet the front end of the toner image on intermediate transfer belt 61.

Fusing unit 7 includes heat roller 71 and pressing roller 72 as fusing rollers 70. Heat roller 71 and pressing roller 72 are arranged so as to rotate and convey the sheet while nipping it.

Next, the sheet feed path in image forming apparatus 100 will be described.

As shown in FIG. 2, image forming apparatus 100 has paper feed cassette 81 for storing sheets beforehand and manual paper feed cassette 82. In order to deliver sheets from these paper feed cassettes 81 and 82, pickup rollers 11*a* and 11*b* are arranged so as to lead sheets, one by one, to feed path S.

The sheet delivered from paper feed cassettes 81 or 82 is conveyed by feed rollers 12*a* on paper feed path S to registration roller 13, by which the sheet is released toward transfer roller 10*a* at such a timing that the front end of the sheet meets the front end of the image information on intermediate transfer belt 61 so that the image information is transferred to the sheet. Thereafter, the sheet passes through fusing unit 7, whereby the unfixed toner on the sheet is fused by heat and fixed. Then the sheet is discharged through feed rollers 12*b* onto paper output tray 91.

The paper feed path described above is that of the sheet for a one-sided printing request.

On the other hand, when a duplex printing request is given, the sheet with its one side printed passes through fusing unit 7 and is held at its rear end by feed roller 12*b*, then the feed roller 12*b* rotates in reverse so as to lead the sheet toward feed rollers 12*c* and 12*d*. Thereafter, the sheet passes through registration roller 13 and is printed on its rear side and discharged onto paper output tray 91.

Next, the configuration of fusing unit 7 that characterizes the present embodiment will be described in detail with reference to the drawings.

Figure 4A:
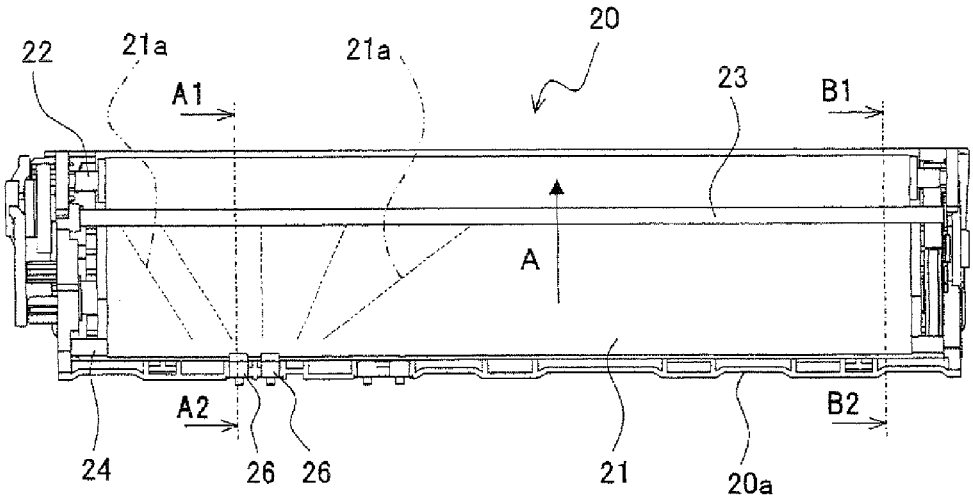
FIG. 4B is a sectional view cut along a plane A1-A2 in FIG. 4A
FIG. 4C is a sectional view cut along a plane B1-B2 in FIG. 4A.
Figure 4B:
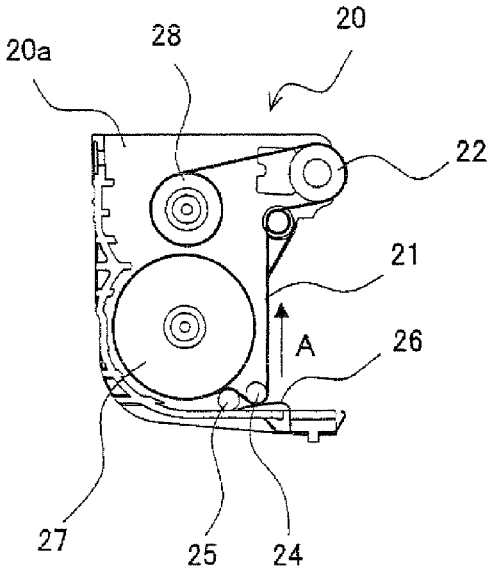
Figure 4C:
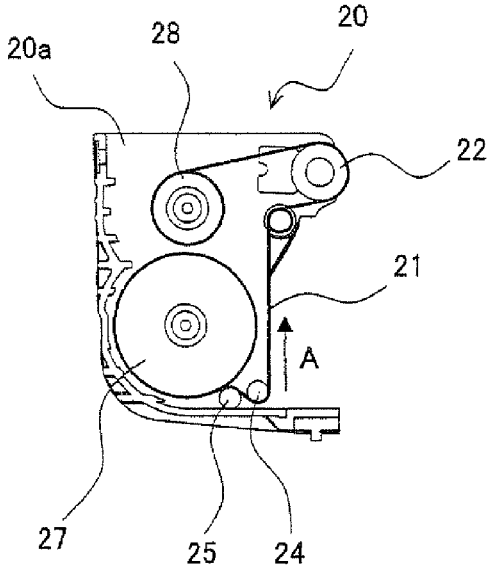

FIG. 4A is an illustrative view showing the overall configuration of a fusing roller cleaning unit that constitutes the fusing unit according to the present embodiment, FIG. 4B is a sectional view cut along a plane A1-A2 in FIG. 4A and FIG. 4C is a sectional view cut along a plane B1-B2 in FIG. 4A.

As shown in FIG. 3, fusing unit 7 according to the present embodiment includes a pair of fusing rollers 70, i.e., heat roller 71 and pressing roller 72, further including fusing roller cleaning unit 20 for cleaning the surface of heat roller 71.

Heat roller 71 and pressing roller 72 are arranged so as to oppose each other and rotate in the directions of arrows B and C, respectively in the drawing. Heat roller 71 and pressing roller 72 form a fusing nip portion 70*a* at their contact.

Heat roller 71 is composed of a metal core and an elastic layer formed on the peripheral surface of the core. The heat roller incorporates a main heater 71*a* and a sub heater 71*b* of halogen lamps.

Though not illustrated, a temperature detector including a non-contact type thermistor is arranged around heat roller 71 so that the surface temperature will be controlled within the range from 160 to 200 deg. C by means of main heater 71*a* and sub heater 71*b*.

Further, heat roller 71 has the function of heating and pressing the toner to the sheet in cooperation with pressing roller 72, so as to thermally fix the multi-color toner image transferred on the sheet to the sheet by fusing, mixing and pressing it. The fusing unit further includes an external heating belt 73 for fixing heat roller 71 from without as shown in FIG. 2.

Similarly to heat roller 71, pressing roller 72 also is composed of a cylindrical metal core and an elastic layer formed on the peripheral surface of the core. This pressing roller is adapted to abut heat roller 71 with a predetermined pressure.

Arranged around heat roller 71 is fusing roller cleaning unit 20 of a web sheet type for wiping the remaining toner on the outer peripheral surface of heat roller 71.

As shown in FIG. 3, fusing roller cleaning unit 20 is essentially composed of a web sheet 21, a pressure roller 22 for pressing web sheet 21 against the outer peripheral surface of heat roller 71, a web sheet delivering roller 27 on which web sheet 21 is rolled, a tension roller 23 for applying predetermined tension to web sheet 21 that is delivered from web sheet delivering roller 27, a first guide roller (metal roller) 24 and second guide roller (guide member) 25 for guiding conveyance of web sheet 21, a winding roller 28 for winding up used web sheet 21 and a web detecting terminal (web material detector) 26 for detecting the end of web sheet 21. These components are accommodated in a unit case 20*a* to form an integrated assembly.

As shown in FIG. 3, web sheet 21 is stretched out in unit case 20*a* from web sheet delivering roller 27 to pressure roller 22 by way of second guide roller 25, first guide roller 24 and tension roller 23 and is taken up by winding roller 28. Conveyance of web sheet 21 is performed so that it moves in the direction of arrow A, which is opposite the direction in which heat roller 71 rotates, at the contact portion with heat roller 71.

Tension roller 23, first guide roller 24 and second guide roller 25 are arranged with their axes positioned essentially parallel to the width direction of web sheet 21 and are formed to have a length exceeding the width of web sheet 21, as shown in FIGS. 4A to 4C.

Tension roller 23 is arranged at a position upstream of pressure roller 22 with respect to the web sheet's direction of conveyance and adjacent to pressure roller 22.

First guide roller 24 is a metal roller formed of a conductive metal member and is arranged upstream of tension roller 23 with respect to the web sheet's direction of conveyance, and is disposed at the position where web detecting terminal 26 abuts web sheet 21, so that the first guide roller opposes web detecting terminal 26 across web sheet 21.

Second guide roller 25 is a metal roller formed of a metal member and is arranged upstream of first guide roller 24 with respect to the web sheet's direction of conveyance, at a position near web detecting terminal 26. Specifically, second guide roller 25 is arranged at a position upstream of first guide roller 24 with respect to the web sheet's direction of conveyance and in the vicinity of first guide roller 24 and upstream of web detecting terminal 26 with respect to the web sheet's direction of conveyance.

Second guide roller 25 is constructed so as to apply uniform tension to web sheet 21 in the web sheet's direction of conveyance, across the full width of web sheet 21.

Web detecting terminal 26 is constructed so as to touch web sheet 21 in the usual condition. When web sheet 21 is not present on first guide roller 24, web detecting terminal 26 abuts first guide roller 24 to produce electric conduction. That is, web detecting terminal 26 directly touches first guide roller 24, whereby providing the function of a presence sensor for detecting whether web sheet 21 exists on first guide roller 24 by use of metal conduction and the function of an end detecting sensor for performing end detection of web sheet 21 when web sheet 21 is used up.

Next, how heat roller 71 is cleaned by fusing roller cleaning unit 20 according to the present embodiment will be described in detail with reference to the drawings.

When the surface of heat roller 71 is cleaned by fusing roller cleaning unit 20, web sheet 21 is pressed against rotating heat roller 71 by means of pressure roller 22 as shown in FIG. 3, so as to clean the heat roller 71 surface with web sheet 21.

When a predetermined condition is reached, e.g., every predetermined period of time image forming apparatus 100 has been operated, or every time a predetermined number of printouts has been made, a predetermined length of web sheet 21 is taken up by winding roller 28 so as to collect the dirtied part and deliver a clean part from web sheet delivering roller 27, so that heat roller 71 can be cleaned by the fresh sheet surface.

As shown in FIGS. 4B and 4C, web sheet 21 in fusing roller cleaning unit 20 is wound in an S-shape on first guide roller 24 and second guide roller 25 arranged adjacent to each other while tension is applied on web sheet 21 by second guide roller 25, so that the web strip is stretched tight without slack between pressure roller 22 abutting heat roller 71 and second guide roller 25.

When web sheet 21 is taken up and collected by winding roller 28 while a predetermined amount of web sheet is delivered from web sheet delivering roller 27, web detecting terminal 26 rubs web sheet 21 and resists motion of web sheet 21 being taken up as shown in FIG. 4B. As a result, web sheet 21 between pressure roller 22 and first guide roller 24 becomes stretched as shown in FIG. 4A. In this condition, web sheet 21 is applied with tension by second guide roller 25.

On the other hand, in the area where no web detecting terminal 26 exists, web sheet 21 located near first guide roller 24 becomes slack due to influence of web detecting terminal 26 abutting web sheet 21. However, since web sheet 21 is being applied with tension by second guide roller 25 as shown in FIG. 4C, web sheet 21 remains stretched without slack.

Accordingly, since web sheet 21 is applied with uniform tension between pressure roller 22 and first guide roller 24 by second guide roller 25 across its full width, rumples (shown by two-dot chain lines) 21*a*, which occurred conventionally as shown in FIG. 4A, will not arise any longer over web sheet 21 near web detecting terminal 26, hence web sheet 21 can be taken up and collected as it is being stretched without slack. In this way, it is possible to deliver a predetermined length of clean web sheet 21 without producing any rumples with it.

According to the present embodiment thus constructed, since, in fusing roller cleaning unit 20, second guide roller 25 is arranged upstream of web detecting terminal 26 with respect to web sheet's direction of conveyance while uniform tension is applied to web sheet 21 across its width, no rumples arise over web sheet 21 so that it is possible to deliver a predetermined length of fresh web sheet 21. Accordingly, it is possible to clean the surface of heat roller 71 uniformly with web sheet 21 free from rumbles, hence it is possible to reliably remove the remaining toner and dirt.

Further, according to the present embodiment, since tension roller 23, first guide roller 24 and second guide roller 25 are arranged with their axes positioned essentially parallel to the width direction of web sheet 21 and are formed to have a length exceeding the width of web sheet 21, web sheet 21 can be prevented from becoming slack across the full width thereof, hence it is possible to prevent web sheet 21 advancing in a skewed manner.

According to the present embodiment, arrangement of second guide roller 25 on the upstream side of web detecting terminal 26 with respect to web sheet's direction of conveyance makes it possible to eliminate the slack of the web sheet on the upstream side of web detecting terminal 26, which would occur due to abutment of web detecting terminal 26, hence it is possible to convey web sheet 21 in a state free from rumples.

According to the present embodiment, since second guide roller 25 is adapted to apply uniform tension across the full width of web sheet 21 to web sheet 21 with respect to the web sheet's direction of conveyance, it is possible to prevent generation of rumples and advancement in a skewed manner due to slack in web sheet 21, hence it is possible to realize stable and correct conveyance of the web sheet.

Further, according to the present embodiment, since use of a metal roller as second guide roller 25 eliminates the fear of the roller itself being deformed by the tension from web sheet 21, hence it is possible to convey web sheet 21 correctly without skewing.

As described heretofore, adoption of the fusing roller cleaning unit 20 for image forming apparatus 100 makes it possible to reliably prevent the recording sheets from being dirtied with leftover toner on heat roller 71, hence it is possible to achieve image printout excellent in image quality.

Having described the preferred embodiment, it goes without saying that the technology should not be limited to the above-described examples, and it is obvious that various changes and modifications will occur to those skilled in the art within the scope of the appended claims. Such variations are therefore understood to be within the technical scope of the technology.

For example, in the above embodiment, the technology is applied to a color image forming apparatus, however the technology can also be applied to a monochrome image forming apparatus including a fusing device for fixing toner images onto recording media. Further, it can be also applied to an apparatus which includes a roller member and needs cleaning of the roller member.

What is claimed is:

1. A fusing device comprising:

fusing rollers, including a pair of roller members, which pass a recording medium with an unfixed toner image formed thereon through a nip portion where the two roller members come into press-contact with each other so as to fuse and fix the toner image onto the recording medium; and a cleaning mechanism, including a web material feeder for supplying a web material and a web material winding portion for taking up the web material, and arranged so as to abut the web material against an outer peripheral surface of the fusing roller to clean the roller surface, characterized in that the cleaning mechanism further includes:

a web material detector which abuts the web material to detect the presence of the web material; and a guide member for guiding conveyance of the web material, on the upstream side of the position where the web material abuts the fusing roller, with respect to the web material's direction of conveyance, and the guide member is arranged upstream of a position where the web material detector abuts the web material with respect to the web material's direction of conveyance.

2. The fusing device according to claim 1, further comprising a metal roller for guiding conveyance of the web material, wherein the metal roller is arranged at a position where the web material detector abuts the web material, so as to oppose the web material detector with the web material put in between, and the web material detector abuts the metal roller when the web material does not exist on the metal roller.

3. The fusing device according to claim 2, wherein the metal roller comprises a first metal guide roller, and wherein the guide member comprises a second metal guide roller.

4. The fusing device according to claim 3, wherein the first metal guide roller rotates in a first direction, the second metal guide roller rotates in a second direction that is opposite to the first direction, and the web material passes between the first and second metal guide rollers.

5. The fusing device according to claim 3, wherein the second metal guide roller applies tension to a portion of the web material located between the first metal guide roller and the web material feeder.

6. The fusing device according to claim 1, wherein the guide member is provided along a width direction of the web material across a range wider than the width of the web material.

7. The fusing device according to claim 1, wherein the guide member applies uniform tension to the web material in the web material's direction of conveyance across a full width of the web material.

8. The fusing device according to claim 1, wherein the guide member is a metal roller.

9. An image forming apparatus comprising:

a photoreceptor drum for forming an electrostatic latent image and forming a toner image based on the electrostatic latent image;

a developing unit including a developing roller for supplying toner to the photoreceptor drum;

a transfer portion for transferring the toner image formed on the photoreceptor drum to a recording medium being conveyed; and, a fusing device for fusing the toner image and fixing it to the recording medium, by passing the recording medium with the unfixed toner image formed thereon through itself, characterized in that:

a printed image is formed on a recording medium electrophotographically by transferring the toner image formed on the photoreceptor drum surface to the recording medium, and the fusing device according to claim 1 is employed as the fusing device.

* * * * *